US005370505A

United States Patent [19]

Takenaka et al.

[11] Patent Number: 5,370,505

[45] Date of Patent: Dec. 6, 1994

[54] AXIAL MULTI-PISTON COMPRESSOR WITH INTERNAL LUBRICATING ARRANGEMENT FOR SHAFT SEAL UNIT

[75] Inventors: Kenji Takenaka; Toru Takeichi; Hiroaki Kayukawa; Shigeyuki Hidaka, all of Kariya, Japan

[73] Assignee: Kabushiki Kaisha Toyoda Jidoshokki Seisakusho, Aichi, Japan

[21] Appl. No.: 73,770

[22] Filed: Jun. 8, 1993

[30] Foreign Application Priority Data

Jun. 8, 1992 [JP] Japan ..... 4-038757[U]

[51] Int. Cl.[5] ..... F04B 1/12

[52] U.S. Cl. ..... 417/269; 92/153; 184/6.17

[58] Field of Search ..... 417/269; 92/153, 154; 184/6.16, 6.17

[56] References Cited

U.S. PATENT DOCUMENTS 4,005,948 2/1977 Hiraga et al. ..... 184/6.17
4,095,921 6/1978 Hiraga et al. ..... 417/269
4,290,345 9/1981 Hiraga et al. ..... 417/269
4,301,716 11/1981 Saegusa et al. ..... 417/269 X
4,683,804 8/1987 Futamura et al. ..... 92/153
4,732,545 3/1988 Ohta et al. ..... 417/269
5,137,431 8/1992 Terauchi et al. ..... 417/269

FOREIGN PATENT DOCUMENTS 59-46378 3/1984 Japan .
61-218783 9/1986 Japan .

*Primary Examiner*—Richard A. Bertsch
*Assistant Examiner*—M. Kocharov
*Attorney, Agent, or Firm*—Burgess, Ryan and Wayne

[57] ABSTRACT

An axial multi-piston compressor having a drive shaft which rotates and a cylinder block having a multiplicity of cylinder bores and pistons within the cylinder bores. The cylinder block is associated with a crank chamber containing the fluid to be compressed and a lubricating oil mist. The peripheral wall of the crank chamber having a groove on the peripheral surface which groove collects oil and directs the oil to the shaft seal. The groove is partially curved in a direction counter to the direction of rotation of the shaft.

2 Claims, 2 Drawing Sheets

AXIAL MULTI-PISTON COMPRESSOR WITH INTERNAL LUBRICATING ARRANGEMENT FOR SHAFT SEAL UNIT

BACKGROUND OF THE INVENTION

1) Field of the Invention

The present invention relates to an axial multi-piston compressor used in, for example, an air-conditioning system incorporated in a vehicle such as an automobile, and more particularly, to an axial multi-piston compressor with an internal lubricating arrangement for a shaft seal unit incorporated therein.

2) Description of the Related Art

Generally, an axial multi-piston compressor comprises: a cylinder block having a plurality of cylinder bores radially formed therein and arranged with respect to the central axis thereof; a plurality of pistons slidably received in the cylinder bores, respectively; a front housing securely fixed to an front end wall of the cylinder block to form a crank chamber therebetween; a drive shaft axially extended through the crank chamber such that the ends thereof are rotatabiy supported by the front housing and the cylinder block, respectively; a conversion mechanism provided on the drive shaft within the crank chamber for converting a rotational movement of the drive shaft into a reciprocation of the pistons; a rear housing securely fixed to a rear end wall of the cylinder block to form a suction chamber and a discharge chamber therebetween; and a valve plate assembly provided between the cylinder block and the rear housing.

The valve plate assembly in particular comprises: a disc-like member having sets of a suction port and a discharge port opened to the suction chamber and the discharge chamber, respectively, each set being able to communicate with the corresponding one of the cylinder bores of the cylinder block; an inner valve sheet attached to the inner side surface of the disc-like member and having suction reed valve elements formed integrally therein, each of which is arranged so as to open and close the corresponding suction port of the disc-like member; and an outer valve sheet attached to the outer side surface of the disc-like member and having discharge reed valve elements formed integrally therein, each of which is arranged so as to open and close the corresponding discharge port of the disc-like member.

When the axial multi-piston compressor is incorporated in an air-conditioning system for a vehicle such as an automobile, the drive shaft is rotationally driven by the prime mover or engine of the automobile, and the suction chamber and the discharge chamber are in communication with an evaporator and a condenser of the air-conditioning system through an inlet port and an outlet port formed in the rear housing, to circulate a refrigerant in the air-conditioning system. The rotational movement of the drive shaft causes the pistons to be reciprocated in the cylinder bores due to the conversion mechanism provided on the drive shaft within the crank chamber. When each piston is reciprocated in the corresponding cylinder bore, and thus a suction stroke and a compression stroke are repeatedly executed therein, a suction stroke is executed in one of the aligned cylinder bores. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

In the axial multi-piston compressor as mentioned above, the crank chamber is in communication with the suction chamber and the discharge chamber through a supply passage and an exhaust passage formed in the cylinder block and having each a suitable control valve incorporated therein, whereby the crank chamber is filled with the refrigerant including a lubricating oil mist. Thus, movable parts of the conversion mechanism are lubricated by the lubricating oil mist included in the refrigerant, whereby a seizure of the movable parts can be prevented.

Also, in the above-mentioned compressor, a front end of the drive shaft is projected outside from an opening formed in a neck portion of the front housing, so that the drive shaft is operatively connected to the prime mover of the vehicle for the rotation thereof. In this case, of course, the crank chamber must be sealed from the outside so that a leakage of the refrigerant through the neck portion of the front housing can be prevented. To this end, a shaft seal unit is provided on the front end of the drive shaft at the neck portion of the front housing, to thereby seal the crank chamber from the outside. The shaft seal unit may comprises a mechanical seal element, a rubber lip seal element or the like.

As is well known, the shaft seal unit should be sufficiently lubricated with a lubricating oil during operation of the compressor, before it can exhibit a proper and good function thereof. Conventionally, it has been proposed that the refrigerant including the lubricating oil mist is utilized for the lubrication of the shaft seal unit. In particular, the shaft seal unit is in communication with the crank chamber through an oil passage formed in an end wall of the front housing, whereby the refrigerant can be introduced from the crank chamber into the shaft seal unit. Nevertheless, the conventional proposal fails to sufficiently lubricate the shaft seal unit with the refrigerant, because, although the refrigerant including the lubricating oil mist merely reaches the shaft seal unit through the oil passage, a sufficient amount of lubricating oil in a liquid phase cannot be fed to the shaft seal unit.

SUMMARY OF THE INVENTION

Accordingly, an object of the present invention is to provide an axial multi-piston compressor with a lubricating arrangement for a shaft seal unit incorporated therein, as mentioned above, wherein the shaft seal unit can be lubricated with a sufficient amount of lubricating oil in a liquid phase.

In accordance with the present invention, there is provided an axial multi-piston compressor comprising: a housing means having an opening formed therein; a drive shaft means rotatably provided in the housing means, one end of the drive shaft means being accessible through the opening of the housing means whereby the end of the drive shaft means is capable to be coupled to an outside drive source; a cylinder block means associated with the housing means so as to form a crank chamber which is filled with a fluid including an lubricating oil mist, the cylinder block means having cylinder bores formed therein and surrounding the drive shaft means; a plurality of piston means slidably received in the cylinder bores of the cylinder block means, respectively; a conversion means provided on the drive shaft means within the crank chamber for converting a rotational movement of the drive shaft means into a reciprocation of each piston means in the corresponding cylinder bore such that a suction stroke and a discharge stroke are alternately executed therein, the fluid being introduced into the cylinder bore during the suction stroke, and during the compression stroke, the introduced fluid being compressed and discharged from the cylinder bore; and a shaft seal means provided on the shaft means at the opening of the housing means to seal the crank chamber from an outside thereof, wherein the housing means has an oil passage formed in a wall portion thereof for communicating the shaft seal means with the crank chamber, and an oil guide groove formed in an inner wall surface of the housing means and extended from an end of the oil passage which is opened to the crank chamber, whereby a liquid-phase lubricating oil separated from the fluid and adhered to the inner wall surface of the housing means is collected in and guided along the oil guide groove to be introduced into the oil passage.

Preferably, the oil guide passage is extended upward to a zone which forms a part of a peripheral inner wall of the housing means. Also, preferably, the oil guide passage is partially curved in a counter direction with respect to a rotational direction of the shaft means, whereby the introduction of the liquid-phase lubricating oil into the oil passage can be facilitated.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
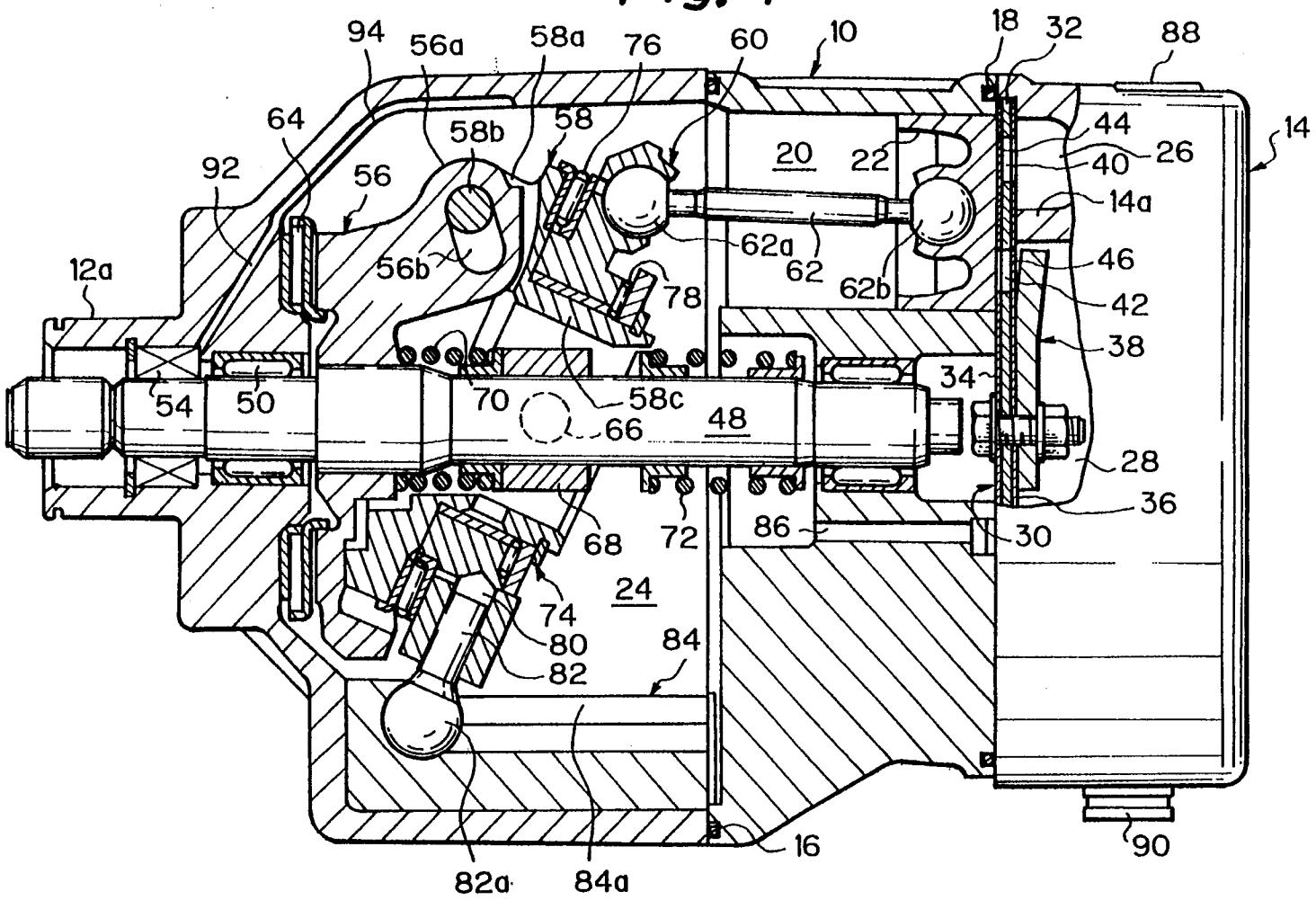
FIG. 1 is a longitudinal sectional view showing an axial multi-piston compressor according to the present invention.

FIG. 1 shows an axial multi-piston compressor in which the present invention is embodied, and which may be used in an air-conditioning system (not shown) for a vehicle such as an automobile. The compressor comprises a cylinder block 10, front and rear housings 12 and 14 securely and hermetically joined to the cylinder block 10 at front and rear end walls thereof through the intermediary of O-ring seals 16 and 18, respectively. The cylinder block 10 has a plurality of cylinder bores, for example, six cylinder bores 20 formed radially and circumferentially therein and spaced from each other at regular intervals, and each of the cylinder bores slidably receives a piston 22. The front housing 12 has a crank chamber 24 defined therewithin, and the rear housing 14 has an annular suction chamber 26 and a central discharge chamber 28 defined therewithin and partitioned by an annular wall portion **14*a* integrally projected from an inner wall of the rear housing 14. Note, the suction chamber 26 and the discharge chamber 28** are in communication with an evaporator and a condenser of the air-conditioning system, respectively, so that a fluid or refrigerant including a lubricating oil mist is supplied from the evaporator to the suction chamber and a compressed refrigerant is delivered from the discharge chamber to the condenser.

A valve plate assembly 30 is disposed between the rear end wall of the cylinder block 10 and the rear housing 14, and includes a disc-like plate member 32, a suction reed valve sheet 34 applied to an inner side surface of the disc-like plate member 32, a discharge reed valve sheet 36 applied to an outer side surface of the disc-like plate member 32, and a retainer member 38 securely attached to an outer side surface of the discharge reed valve sheet 36. The disc-like member 32 may be made of a suitable metal material such as steel, and has six sets of suction and discharge ports 40 and 42 formed radially and circumferentially therein and spaced from each other at regular intervals, so that each set of the suction and the discharge ports 40 and 42 is encompassed within an end opening area of the corresponding one of the cylinder bores 20, as shown in FIG. 1.

The suction reed valve sheet 34 and the discharge reed valve sheet 36 may be made of spring steel, phosphor bronze, or the like. The suction reed valve sheet 34 has six suction reed valve elements 44 formed integrally therewith and arranged radially and circumferentially to be in register with the suction ports 40, respectively, whereby each of the suction reed valve elements 42 can be moved so as to open and close the corresponding suction port 40, due to a resilient property thereof. Also, the discharge reed valve sheet 36 has six discharge reed valve elements 46 formed integrally therewith and arranged radially and circumferentially to be in register with the discharge ports 42, respectively, whereby each of the discharge reed valve elements 46 can be moved so as to open and close the corresponding suction port 42, due to a resilient property thereof. The retainer member 38 may be made of a suitable metal material such as steel, and is preferably coated with a very thin rubber layer.

The retainer member 38 has six retainer elements **38*a* radially extended therefrom and arranged radially and circumferentially to be in alignment with the discharge reed valve elements 46, respectively. As shown in FIG. 1, each of the retainer elements 38*a* provides a sloped bearing surface for the corresponding one of the discharge reed valve elements 46, so that each discharge reed valve element 42** is opened only by a given angle defined by the sloped bearing surface.

A drive shaft 48 extends within the front housing 12 so that a rotational axis thereof matches a longitudinal axis of the front housing 12, and a front end of the drive shaft 48 is projected outside from an opening formed in a neck portion **12*a* of the front housing 12 and is operatively connected to a prime mover of the vehicle for rotation of the drive shaft 48. The drive shaft 48 is rotatably supported by a first radial bearing 50 provided in the opening of the neck portion 12*a* and by a second radial bearing 52 provided in a central bore formed in the cylinder block 10. A shaft seal unit 54 such as a lip seal unit, a mechanical seal unit or the like is provided in the opening of the neck portion 12*a* adjacent to the first radial bearing 50, to thereby seal the crank chamber 24** from the outside.

A conversion mechanism is provided on the drive shaft 48 within the crank chamber 24 for converting a rotational movement of the drive shaft 48 into a reciprocation of the pistons 22. In this embodiment, the conversion mechanism comprises, as a main element thereof, a drive plate member 56, a swingable annular plate member 58, a wobble plate member 60, and six connecting rods 62.

The drive plate member 56 is securely mounted on the drive shaft 48 so as to be rotated together therewith, and a thrust bearing 64 is disposed between the drive plate member 56 and an inner end wall portion of the front housing 12.

The annular plate member 58 is swingably supported by a pair of pin elements 66 projected diametrically from a sleeve member 68 slidably mounted on the drive shaft 48. Namely, the annular plate member 58 has a central opening through which the drive shaft 40 is extended, and is swingable around a lateral axis defined by the pair of pin elements 66. Note, in FIG. 1, only one pin element 66 is illustrated by a broken line. The drive plate member 56 is provided with an extension **56*a* having an elongated guide slot 56*b* formed therein, and the annular plate member 58 is provided with a bracket portion 58*a* projected integrally therefrom and having a guide pin element 58*b* received in the guide slot 56*b*, whereby the annular plate member 58 can be rotated together with the drive plate member 56. Note, a slide movement of the sleeve member 68 is resiliently restrained by two coil springs 70 and 72 provided on the drive shaft 48 at the sides of the sleeve member 68**.

The wobble plate member 60 is slidably mounted on a sleeve portion **58*c* projected integrally from a peripheral annular edge by which the central opening of the annular plate member 58, and is held in place by a retaining ring assembly 74 incorporated in the sleeve portion 58*c* of the annular plate member 58. Note, as shown in FIG. 1, two thrust bearing 76 and 78 are disposed between the annular plate member 58 and the wobble plate member 60 and between the wobble plate member 60 and the retaining ring assembly 74, respectively. The wobble plate member 60 has a radial smooth bore 80 formed therein, and a guide pin 82 slidably received in the bore 80 and having a spherical head 82*a* formed as an outer end thereof. On the other hand, a block member 84 is securely attached to a peripheral inner wall of the front housing 12, and has a guide groove 84*a* formed therein and extended in parallel to the longitudinal axis of the drive shaft 48. The spherical head 82*a* of the guide pin 82 is slidably received in the guide groove 84*a* of the block member 84**, whereby the wobble plate member is swingable together with the annular plate member, but cannot be rotated.

Each of the connecting rods 62 has spherical shoe elements **62*a* and 62*b* formed at ends thereof and slidably received in spherical recesses formed in the wobble plate member 60 and the corresponding piston 22, respectively, whereby an operational connection is established between the wobble plate member 60 and the pistons 22. Namely, when the annular plate member 58 is rotated by the drive shaft 48, the wobble plate member 60 is swung about the pair of pin elements 66, so that each of the pistons 22 is reciprocated in the corresponding cylinder bore 20**.

In operation, during the rotation of the drive shaft 48, the pistons 22 are reciprocated in the cylinder bores 20, respectively, so that a suction stroke and a compression stroke are alternately executed in each of the cylinder bores 20. During the suction stroke, the suction reed valve 44 is opened, so that the refrigerant is introduced from the suction chamber 26 into the bore 20 through the suction port 40. During the compression stroke, the suction reed valve 44 is closed, so that the introduced refrigerant is compressed in the bore 20. When the pressure of the compressed refrigerant is higher than that in the discharge chamber 28, the discharge reed valve is opened, so that the compressed refrigerant is discharged from the bore 20 into the discharge chamber 28 through the discharge port 42.

In this embodiment, the crank chamber 24 is in communication with the discharge chamber 28 through a supply passage 86 formed in the cylinder block 10, and the supply passage 86 is closed and opened by a suitable control valve 88 incorporated in the rear housing 14. Also, the crank chamber 24 is in communication with the suction chamber 26 through a exhaust passage (not visible in FIG. 1) formed in the cylinder block 10, and the exhaust passage is closed and opened by a suitable control valve 90 incorporated in the rear housing 14. Accordingly, a pressure within the crank chamber is variable, whereby a stroke length of the pistons 22 is adjustable.

As mentioned above, the crank chamber 24 is supplied with the refrigerant from the discharge chamber 28, and thus forms a plenum chamber filled with the refrigerant. This is significant because the movable parts of the conversion mechanism can be lubricated by the lubricating oil mist included in the refrigerant, whereby a seizure of the movable parts can be prevented.

Figure 2:
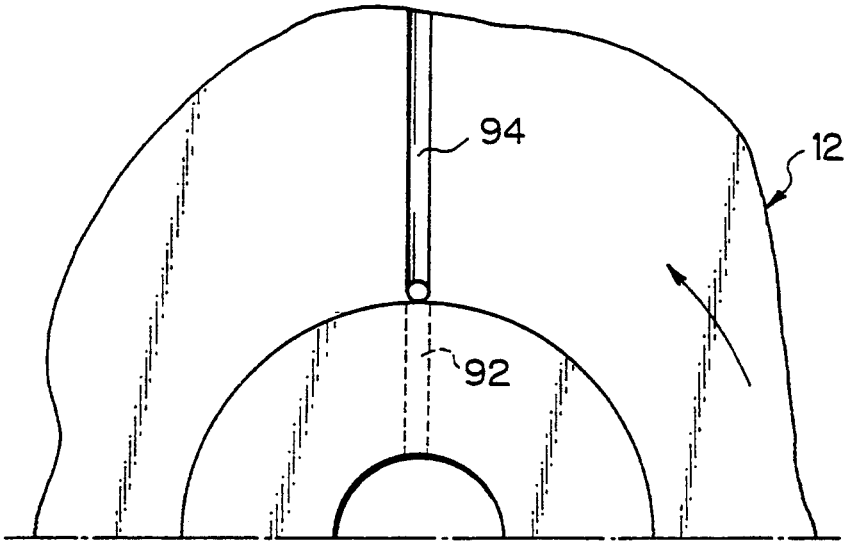
FIG. 2 is a partially developed view showing an inner wall of a front housing of the compressor shown in FIG. 1, in which an oil guide groove is formed.

According to the present invention, a part of the refrigerant filled in the crank chamber 24 is also utilized to lubricate the shaft seal unit 54. To this end, an oil passage 92 is formed in the end wall portion of the front housing 12 for communicating the shaft seal unit 54 with the crank chamber 24, and features an oil guide groove 94 formed in the inner wall surface of the front housing 12. The oil passage 92 is opened to the crank chamber 24 and the shaft seal unit 54 at the inner and outer ends thereof, respectively, and the oil guide groove 94 is upward extended from the inner open end of the oil passage 92 to a zone which forms a part of the peripheral inner wall of the front housing, as shown in FIGS. 1 and 2. Note, the compressor is incorporated in a vehicle such as an automobile to position the block member 84 at the bottom, i.e., to assume an attitude as shown in FIG. 1, and thus the word "upward" used to define the extension of the oil guide groove 94 is definite.

During the operation of the compressor, an lubricating oil in a liquid phase appears on the surfaces of the movable parts of the conversion mechanism, because a part of the refrigerant is relatively impinged against the surfaces of the movable parts to thereby cause separation of the lubricating oil mist from the refrigerant as an oil drop. Of course, the liquid-phase oil lubricates the movable parts of the conversion mechanism. On the other hand, a part of the liquid-phase oil is spattered toward and adhered to the peripheral inner wall of the front housing due to a centrifugal force produced by the rotational movement of drive plate member 56 and the annular plate member 58. Also, the refrigerant in the crank chamber 24 is subjected to a dynamic force derived from the rotational movement of the drive plate member 56 and the annular plate member 58. For example, when these members 56 and 58 are rotated in a direction indicated by an arrow shown in FIG. 2, a stream of the refrigerant is forcibly produced in the same rotational direction due to the dynamic force derived from the rotational movement of the members, and thus the separation of the lubricating oil mist from the refrigerant is caused on the inner wall of the crank chamber 24. In any event, the liquid-phase oil appears on the inner wall of the crank chamber 24 during the operation of the compressor. Accordingly, a part of the liquid-phase oil adhered to the inner wall of the crank chamber 24 is collected in the oil guide groove 94, and is then introduced into the oil passage 92, whereby the shaft sealing unit 54 can be sufficiently lubricated.

Figure 3:
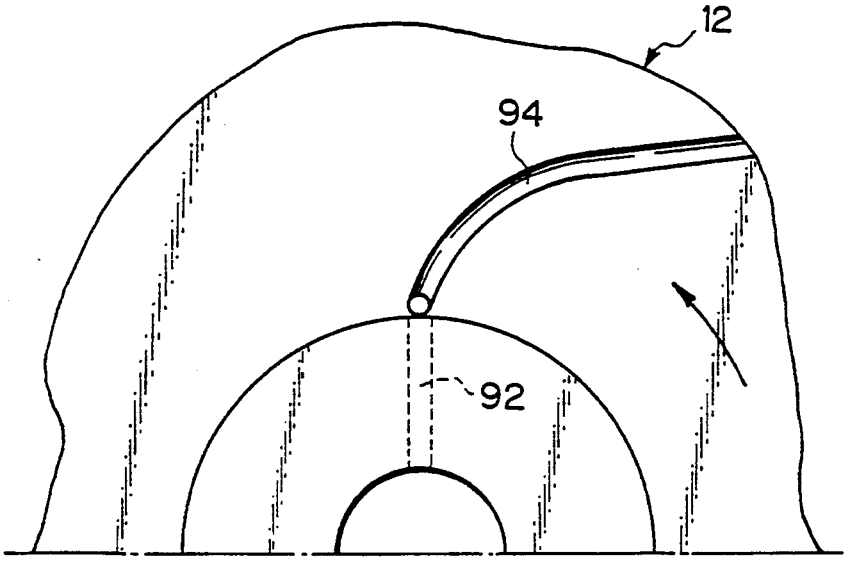
FIG. 3 is a partially developed view showing a modification of an arrangement of the oil guide groove shown in FIG. 2.

FIG. 3 shows a modification of the embodiment as shown in FIGS. 1 and 2. This modified embodiment is identical to the embodiment of FIGS. 1 and 2 except that the oil guide groove 94 is partially curved in a counter direction with respect to the rotational direction of the drive shaft. With this arrangement, the introduction of the liquid-phase lubricating oil into the oil passage 92 can be facilitated because the refrigerant is streamed in the rotational direction of the drive plate member 56 and the annular plate member 58.

Finally, it will be understood by those skilled in the art that the foregoing description is of preferred embodiments of the disclosed compressor, and that various changes and modifications may be made to the present invention without departing from the spirit and scope thereof.

I claim:

1. An axial multi-piston compressor comprising:

a housing means having an opening formed therein;

a drive shaft means rotatably provided in said housing means, one end of said drive shaft means being accessible through the opening of said housing means whereby the end of said drive shaft means can be coupled to an outside drive source;

a cylinder block means associated with said housing means so as to form a crank chamber which is filled with a fluid including a lubricating oil mist, said cylinder block means having cylinder bores formed therein and surrounding said drive shaft means;

a plurality of piston means slidably received in the cylinder bores of said cylinder block means, respectively;

a conversion means provided on said drive shaft means within said crank chamber for converting a rotational movement of said drive shaft means into a reciprocation of each piston means in the corresponding cylinder bore such that a suction stroke and a discharge stroke are alternately executed therein, the fluid being introduced into said cylinder bore during the suction stroke, and during the compression stroke, the introduced fluid being compressed and discharged from said cylinder bore; and a shaft seal means provided on said shaft means at the opening of said housing means to seal the crank chamber from the outside thereof, wherein said housing means has an oil passage formed in a wall portion thereof for communicating said shaft seal means with said crank chamber, and an oil guide groove formed in an inner wall surface of said housing means, the oil guide groove extending from an end of said oil passage which is opened to said crank chamber, whereby liquid-phase lubricating oil separated from said fluid and adhered to the inner wall surface of said housing means is collected in, and guided along, said oil guide groove to be introduced into said oil passage, and wherein the oil guide groove extends upwardly into a zone forming a part of a peripheral inner wall of the housing means, and is partially curved in a counter direction with respect to a rotational direction of the shaft means, whereby the introduction of the liquid-phase lubricating oil into the oil passage is facilitated.

2. An axial multi-piston compressor as set forth in claim 1, wherein said compressor is used in an air-conditioning system incorporated in a vehicle such as an automobile, and said fluid is a refrigerant including an oil mist.

* * * * *